United States Patent [19]

Galda et al.

[11] Patent Number: 4,961,986

[45] Date of Patent: Oct. 9, 1990

[54] SEALING MEMBER FOR A CONTAINER

[75] Inventors: Michael P. Galda, Acton; Stephen H. Witt, Smithville, both of Canada

[73] Assignee: Stanpac Inc., Smithville, Canada

[21] Appl. No.: 162,787

[22] Filed: Mar. 2, 1988

[30] Foreign Application Priority Data

Sep. 9, 1987 [CA] Canada ..... 546450

[51] Int. Cl.[5] ..... B32B 7/06; B32B 7/10; B32B 7/14

[52] U.S. Cl. ..... 428/201; 428/344; 428/351; 428/354; 428/349; 215/232; 215/250; 215/305; 215/350

[58] Field of Search ..... 428/200, 201, 344, 351, 428/354, 347, 349, 579, 582, 594; 156/291; 215/232, 250, 305, 350; 427/208.2, 208.8, 208.4

[56] References Cited

U.S. PATENT DOCUMENTS

| | | | |
|---|---|---|---|
| 713,824 | 11/1902 | White | 215/298 |
| 745,195 | 11/1903 | Kimsey | 215/298 |
| 756,601 | 4/1904 | Doremus | 215/298 |
| 830,735 | 9/1906 | Olsson | 215/298 |
| 895,719 | 8/1908 | Bradley | 215/298 |
| 902,843 | 11/1908 | Sheppard | 215/298 |
| 1,073,071 | 9/1913 | Hall | 215/298 |
| 2,050,248 | 8/1936 | Eisen | 428/344 |
| 2,937,481 | 5/1960 | Palmer | 215/347 |
| 3,032,225 | 5/1962 | Harding | 215/250 |
| 3,317,068 | 5/1967 | Betner | 215/305 |
| 3,632,004 | 1/1972 | Grimes et al. | 215/40 |
| 3,900,125 | 8/1975 | Wyler et al. | 215/341 |
| 4,044,941 | 8/1977 | Knudsen | 215/232 |
| 4,155,439 | 5/1979 | Fletcher et al. | 271/195 |
| 4,209,126 | 6/1980 | Elias | 229/43 |
| 4,324,601 | 4/1982 | Dembicki et al. | 215/232 |
| 4,423,819 | 1/1984 | Cummings | 215/232 |
| 4,442,129 | 4/1984 | Niwa et al. | 215/232 |
| 4,452,842 | 6/1984 | Borges et al. | 428/95 |
| 4,462,502 | 7/1984 | Luenser et al. | 215/329 |
| 4,469,754 | 9/1984 | Hoh et al. | 428/476.3 |
| 4,501,371 | 2/1985 | Smalley | 215/232 |
| 4,514,248 | 4/1985 | Cummings | 156/268 |
| 4,526,562 | 7/1985 | Knudsen et al. | 493/80 |
| 4,527,703 | 7/1985 | Cummings | 215/232 |
| 4,576,297 | 3/1986 | Larson | 215/250 |
| 4,579,240 | 4/1986 | Ou-Yang | 215/232 |
| 4,588,099 | 5/1986 | Diez | 215/232 |
| 4,588,465 | 5/1986 | Paciorek | 156/220 |
| 4,625,875 | 12/1986 | Carr et al. | 215/232 |
| 4,666,052 | 5/1987 | Ou-Yang | 215/230 |
| 4,722,447 | 2/1988 | Crisci | 215/232 |
| 4,735,335 | 4/1988 | Torterotot | 220/270 |
| 4,754,890 | 7/1988 | Ullman | 215/232 |
| 4,762,246 | 8/1988 | Ashley et al. | 220/270 |
| 4,778,698 | 10/1988 | Ou-Yang | 428/344 |

FOREIGN PATENT DOCUMENTS

| | | |
|---|---|---|
| 040797 | 2/1981 | European Pat. Off. . |
| 128434 | 12/1984 | European Pat. Off. . |
| 135431 | 3/1985 | European Pat. Off. . |
| 2327161 | 5/1977 | France . |
| 209616 | 4/1940 | Switzerland . |
| 659633 | 12/1978 | Switzerland . |
| 283050 | 1/1928 | United Kingdom . |
| 2072131 | 9/1981 | United Kingdom . |

*Primary Examiner*—George F. Lesmes
*Assistant Examiner*—J. Davis
*Attorney, Agent, or Firm*—Rogers, Bereskin & Parr

[57] ABSTRACT

A sealing member for a container has a membrane, e.g. aluminum foil, and a first sheet, e.g. polyester, part of which is bonded to the membrane. The other part of the sheet is free, so as to form a tab, to enable the seal to be detached. The seal can be attached to the neck of a bottle by a hot melt adhesive. The sheet and membrane can be stamped from a compound sheet and be of the same size.

35 Claims, 2 Drawing Sheets

SEALING MEMBER FOR A CONTAINER

FIELD OF THE INVENTION

This invention relates to a sealing member or closure for a container, and more particularly is concerned with a sealing member that includes a tab to facilitate removal of the sealing member.

BACKGROUND OF THE INVENTION

There are known for a wide variety of containers, various seals or closures which are sealed to the container around an opening to close the opening. To open the container, the seal has to be broken, providing an indication that the container has been opened, or possibly tampered with. Such seals or closures are used in a wide variety of containers, e.g. bottles of pharmaceuticals, foods, beverages, etc. In some cases their primary function is to provide an element of security, and an indication if the contents have been tampered with. For foods, they are frequently used to seal the foods, so as to maintain the freshness of the food and prevent contamination of the food.

The following U.S. patents all relate in general terms to seals for containers, and were considered during the preparation of this application.

713,824 (White)
745,195 (Kimsey
756,601 (Doremus)
830,735 (Olsson)
895,719 (Bradley)
902,843 (Sheppard)
1,073,071 (Hall)
2,937,481 (Palmer)
3,032,225 (Harding)
3,317,068 (Betner)
3,632,004 (Grimes)
3,900,125 (Wyler)
4,044,941 (Knudsen)
4,155,439 (Fletcher et al)
4,324,601 (Dembicki)
4,423,819 (Cummings)
4,442,129 (Niwa)
4,462,502 (Luenser)
4,469,754 (Hoh et al)
4,501,371 (Smalley)
4,514,248 (Cummings)
4,526,562 (Knudsen et al)
4,527,703 (Cummings)
4,576,297 (Larson)
4,579,240 (Ou-Yang)
4,588,099 (Diez)
4,625,875 (Carr)
4,666,052 (Ou-Yang)

The seven earlier patents all relate generally to closures for bottles or containers including a shoulder or annular recess for a disk or card closure or the like, and many of them are particularly concerned with milk bottles. Some of these patents show tabs for assisting removal of the closure, but in general the structures are not suitable for simple, economical mass production, and they are not concerned with seals that can be bonded to the neck of a bottle.

In the White patent, a strip is secured to the disk closure by paste and its ends form tabs for removal of it.

Pat. No. 745,195 discloses a closure provided with an upper disk secured to the main disk and having a segment removed so it can be grasped. The drawings show a staple securing the two parts together.

Pat. No. 756,601 forms a tab by folding a single sheet of a certain shape.

In Pat. No. 830,735, there is disclosed a closure in which an upper disk is mounted over a lower disk and is larger. Whilst it is suggested that any suitable fastening could be employed, only shellac or a staple are disclosed.

Pat. No. 895,719 discloses a bottle or jar closure including a liftable pull tab in the centre of the disk.

Pat. No. 902,843 is concerned with a disk provided with a thread for lifting the closure.

The Hall patent again discloses a milk bottle seal, which includes a central flap for lifting the seal. A disadvantage with such an arrangement is the difficulty of bonding the two layers together whilst leaving the flap free.

The Palmer Pat. No. 2,937,418 is of some interest, as apparently being an early example of induction sealing of the closure to the neck of a bottle. However, it does not address the problem of providing any tab or the like to facilitate removal of the seal.

The Harding Pat. No. 3,032,225 discloses a combination closure which includes a tear-off cap. This is formed from thin aluminium and includes a tear-off tongue. No discussion is given as to how this would be formed. Experience with such tear-off tongues or tabs for aluminium foil closures indicates that they frequently do not function as intended. Often, instead of enabling the whole closure to be removed, a thin strip is torn from the middle of the closure.

The Betner Pat. No. 3,317,068 is concerned with tear-open sealed containers, and includes a multi-layer closure with a central pull tab.

The Grimes Pat. No. 3,632,004 tackles the problem of facilitating the removal of the closure or seal in a different manner. Here, a recess or notch is provided in the neck of the bottle, so that a portion of the closure overhangs it. This does not greatly facilitate removal of the closure. The user has to grasp a relatively small edge portion of the closure, and this is not practical for thin flexible seals. However, the notch is relatively small in width, so that again there is the potential for a foil seal to be torn, rather than removed as a whole.

The Wyler patent discloses a container for a pharmaceutical or cosmetic product with a foil closing the opening. This includes a tear-off flap. However, no great details are given as to how this would be formed.

The Carr et al Pat. No. 4,625,875 is primarily concerned with a tamper-evident closure. It does show a foil disk provided with a tab. This tab has to be folded over within the cap. No details are given as to how this would be formed or assembled.

The Fletcher et al Pat. No. 4,155,439 should also be noted. This is the only patent that discusses in detail the production of a flexible end closure with a folded pull tab. As shown in this patent, complex machinery is required to form the closure and fit it to the container. A circular table or platform is provided, on which the containers are placed. The table is then rotated, to move each container through numerous different stations. At each station a different operation is performed. The closure itself is stamped from a strip of foil, and then the tab has to be folded up on top of the main portion of it. A complex sequence is required to mount the closure to the container. To set up such machinery for a particular production run is time consuming and expensive.

Additional problems are encountered with this sort of technique. Firstly, the presence of the inwardly folded tab can affect the sealing by means of induction heating. Induction heating relies upon the generation of currents and hence heat in the foil. The presence of the tab affects the electrical properties locally, and can result in improper sealing. As discussed in an article by Bill Zito in the August, 1986 issue of Food and Drug Packaging, the current tends to follows the actual periphery of the tab. Also, the folded tab can stick to the inside of the cap, which then requires a silicone liner or the like. Additionally, the induction sealing technique relies upon the fact that the foil closure is pressed against the neck of the container by the cap. With the folded tab present, there may not be even pressure applied to the foil closure, which again can result in imperfect sealing.

Even if proper sealing is achieved, the tab itself often does not provide for reliable opening of the container. Ideally, the tab and the whole circular foil closure should be removable as one piece. In practice, when the tab is lifted to detach the foil from the bottle or container neck, only the portion of the foil adjacent to the tab becomes detached from the container. Then, the tab simply pulls away a strip of foil across the container. This then leaves the user to manually remove the remaining pieces of the foil. For many uses, it is quite undesirable for the user to have to insert his or her fingers into the neck of the container, as this can result in contamination. Such uses could be pharmaceutical products, and food and beverages dispensed at restaurants.

As suggested by the Fletcher et al patent and many other earlier proposals, a common technique for sealing a foil to the neck of a container is by induction heating. This requires the foil sealing member or closure to be inserted into a cap. The cap is then fitted, usually by screwing onto the neck of the container, so as to press the foil against the neck of the container. The neck of the container is then passed through an induction heater, which induces currents in the foil, melting an appropriate adhesive on the foil, causing it to bond to the neck of the bottle. One step in this process is the fitting of the foil into the cap, and the subsequent fitting of the cap to the neck of the container. For this purpose, the foil closure by itself must be capable of being retained within the cap. For simple aluminium foil sealing members or closures this does not always work perfectly. Aluminium has plastic characteristics; in other words, when the foil is pressed into a screw cap, the edges of the foil can deflect permanently as they pass over the screw threads. The edges of the foil do not snap-back into the grooves of the screw thread. Consequently, the foil can drop out before the cap is fitted to the container neck.

Accordingly, what is desired is a sealing member or closure which can be readily fitted to the neck of a container. It should be capable of being produced simply and economically on conventional machinery, without numerous complex forming operations. Ideally, it should be of uniform thickness throughout, and should be capable of uniform induction heating, so that it can be readily joined to the neck of a bottle by induction heating. Further, it is desirable that at least one edge portion should include elastic, as opposed to plastic properties, so that when inserted into a cap, it will snap-back into the grooves of the screw thread of the cap to retain the sealing member in position prior to induction heating and bonding.

BRIEF SUMMARY OF THE PRESENT INVENTION

In accordance with the present invention, there is provided a sealing member, adapted for securing to a lip around an opening of a container to close the container, the sealing member comprising: a membrane having a periphery, one side of which is for bonding to the neck of a container; a first sheet; a first layer of adhesive between the membrane and the sheet bonding facing portions of the membrane and the first sheet together to form a composite portion whilst leaving at least one portion of the first sheet free in a separated portion of the sealing member, the free portion of the first sheet forming a tab, wherein a part of the periphery of the membrane bounding that portion of the membrane forming the composite portion is common with a corresponding part of the periphery of the first sheet; and an additional layer of adhesive on one side of the membrane which is adapted for bonding to the neck of the container, with the first layer of adhesive bonding the first sheet and the membrane together so strongly that, in use, the first sheet of the membrane can be removed as a unit from the lip of the container to open the container.

The first sheet and the membrane optionally have a common periphery. The sealing member may have the first layer of adhesive extending between opposite parts of the periphery of the membrane and up to a line extending across the membrane between ends of said opposite peripheral parts, the line separating the composite portion from a separated portion including a free tab. Also, a second sheet can be provided, secured to the first sheet by a further layer of adhesive to reinforce the first sheet. These various features may be provided in various combinations.

In a preferred form of the invention, the sheet is bonded to the membrane across all of one side of the sheet up to the line, whilst the other side of the sheet forms a single tab. However, it is possible for the bonded portion of the sheet to be a central strip of the sheet, with a line on either side, so as to leave tabs on either side thereof.

The surface of the membrane remote from the first sheet is coated with a layer of an adhesive. The term "adhesive" is used in the specification including the claims to mean any adhesive capable of bonding the membrane to the lip of a container, and includes thermoplastics and pressure-sensitive adhesives. Preferably, the adhesive is a hot melt bonding material, and in the specification including the claims, a "hot melt bonding material" means a material which upon heating, for example as a result of induction heating of a metal membrane, melts, to enable the membrane to be bonded to the lip or neck of a container, and encompasses both thermoplastic materials and adhesives.

The present invention also provides a cap in combination with a sealing member as just defined.

DESCRIPTION OF THE DRAWING FIGURES

For a better understanding of the present invention and to show more clearly how it may be carried into effect, reference will now be made, by way of example, to the accompanying drawings, which show a preferred embodiment of the present invention, and in which.

DESCRIPTION OF THE PREFERRED EMBODIMENT

Figure 1:
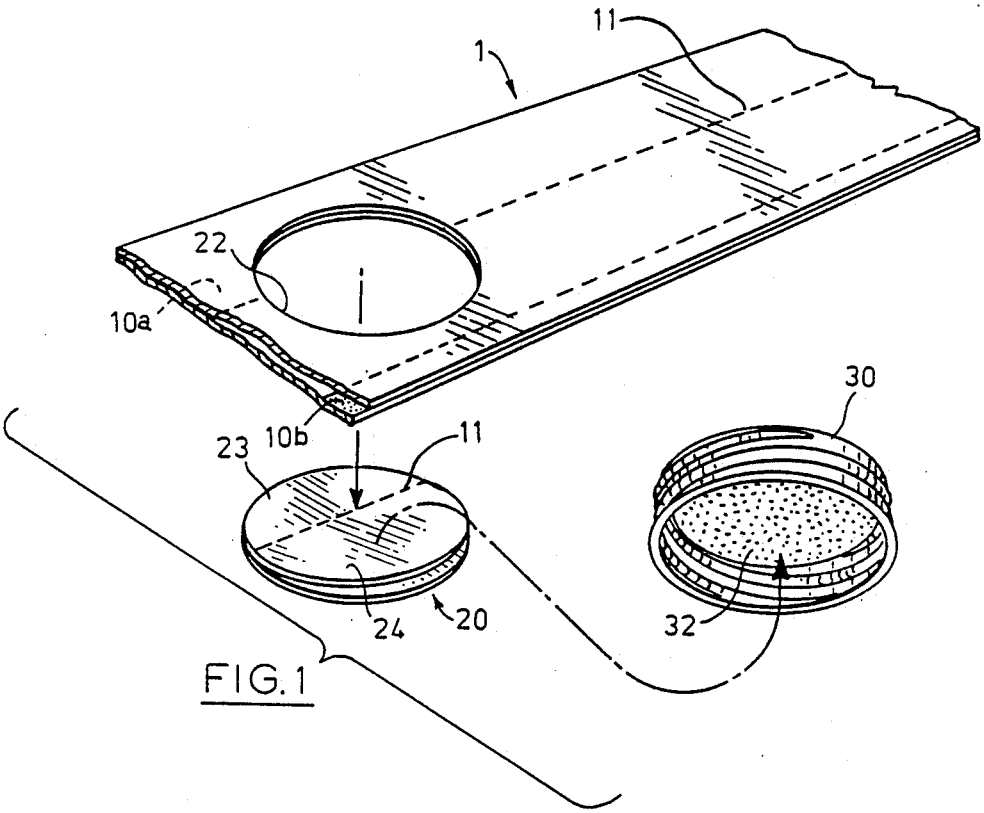
FIG. 1 is a perspective view of an elongate strip according to the present invention, showing a sealing member stamped from the strop and a corresponding cap.
Figure 4:
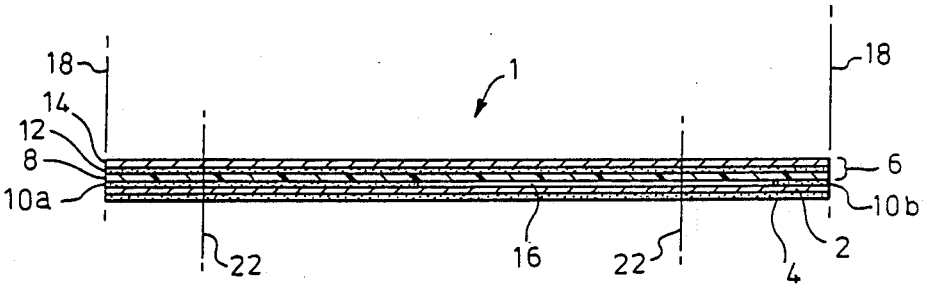
FIG. 4 is a sectional view perpendicular to the axis of the elongate strip of FIG. 1.

With reference to FIGS. 1 and 4, an elongate strip according to the present invention is designated by the numeral 1. As described in greater detail below, the elongate strip 1 can be of indefinite length, and can form part of a wider strip.

The elongate strip 1 has a membrane 2. A lower surface of the membrane 2 is coated with a hot melt bonding material or adhesive 4. A sheet 6 is a laminate sheet comprising a number of separate layers. The sheet 6 has a first sheet 8. Between the first sheet 8 and membrane 2, there is a first layer of adhesive 10. This layer of adhesive 10 does not extend across the full width of the strip 1, as detailed below.

A further layer of adhesive 12 is provided on top of the first sheet 8 and bonds a second sheet 14 to the first sheet 8.

The section through the elongate strip 1, shown in FIG. 4, is constant along its length (for clarity, the thickness of the various layers is amplified in FIG. 4). The first layer of adhesive 10 comprises two portions. A major portion, designated 10*a* extends along the left hand side of the strip as viewed in FIG. 4. A narrow portion 10*b* can extend along the right hand side of the strip 1, again as viewed in FIG. 4. This leaves a gap 16, where the membrane 2 and first sheet 8 are not bonded to one another.

In practice, the elongate strip 1 would be produced as part of a wider strip containing a number of the elongate strips 1. The edges of the elongate strip 1 are defined by the boundaries 18 in FIG. 4, and in the wider strip the elongate strips 1 would be continuous at their boundaries 18. Thus, the wide portion 10*a* would be continuous with the narrow portion 10*b* of an adjacent strip. Appropriate edge regions would be provided along either edge of the wider strip. Thus, typically to accommodate tolerances in the machinery, wider portions 10*a*, 10*b* would be provided along either edge of the wider strip.

Referring to FIG. 1, once the elongate strip has been formed, separate sealing members, designated 20 can be die cut from the strip. Each sealing member is die cut generally centrally from the elongate strip 1 as indicated by the vertical lines 22 in FIG. 4. The sealing member 20 is circular.

The adhesive portion 10*a* has a straight edge or line 11 which in the illustrated embodiment is straight bounding the gap 16. This line 11 extends approximately diametrically across the sealing member 20, as shown in FIG. 1.

The sealing member 20 thus includes a composite portion 23, and a separated portion 24 with the line 11 running between them. In the composite portion, the wide portion 10*a* of the first layer of adhesive results in the various layers being bonded together. In the separated portion 24, the laminate sheet 6 is separate and free from the membrane 2. It should be noted that the sealing member 20 is cut so as to be clear of the narrow portion 10*b* of the adhesive layer. The narrow portion 10*b* is included simply to hold the right hand edges of the membrane 2 and the laminate sheet 6 together to prevent them from flapping or becoming folded etc. In known manner, the various dimensions can be chosen so as to maximize the use of the material. Thus, the narrow portion 10*b* can be kept as narrow as possible, and the width of the strip 1 and the spacing of the sealing members along it can be selected to obtain the maximum number of sealing members 20.

Figure 5:
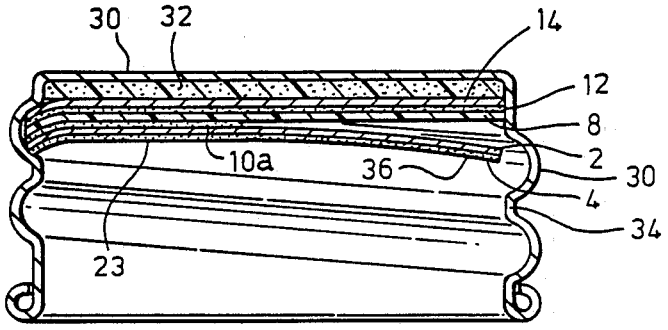
FIG. 5 is a sectional view through a cap fitted with a sealing member of the present invention.
Figure 1:
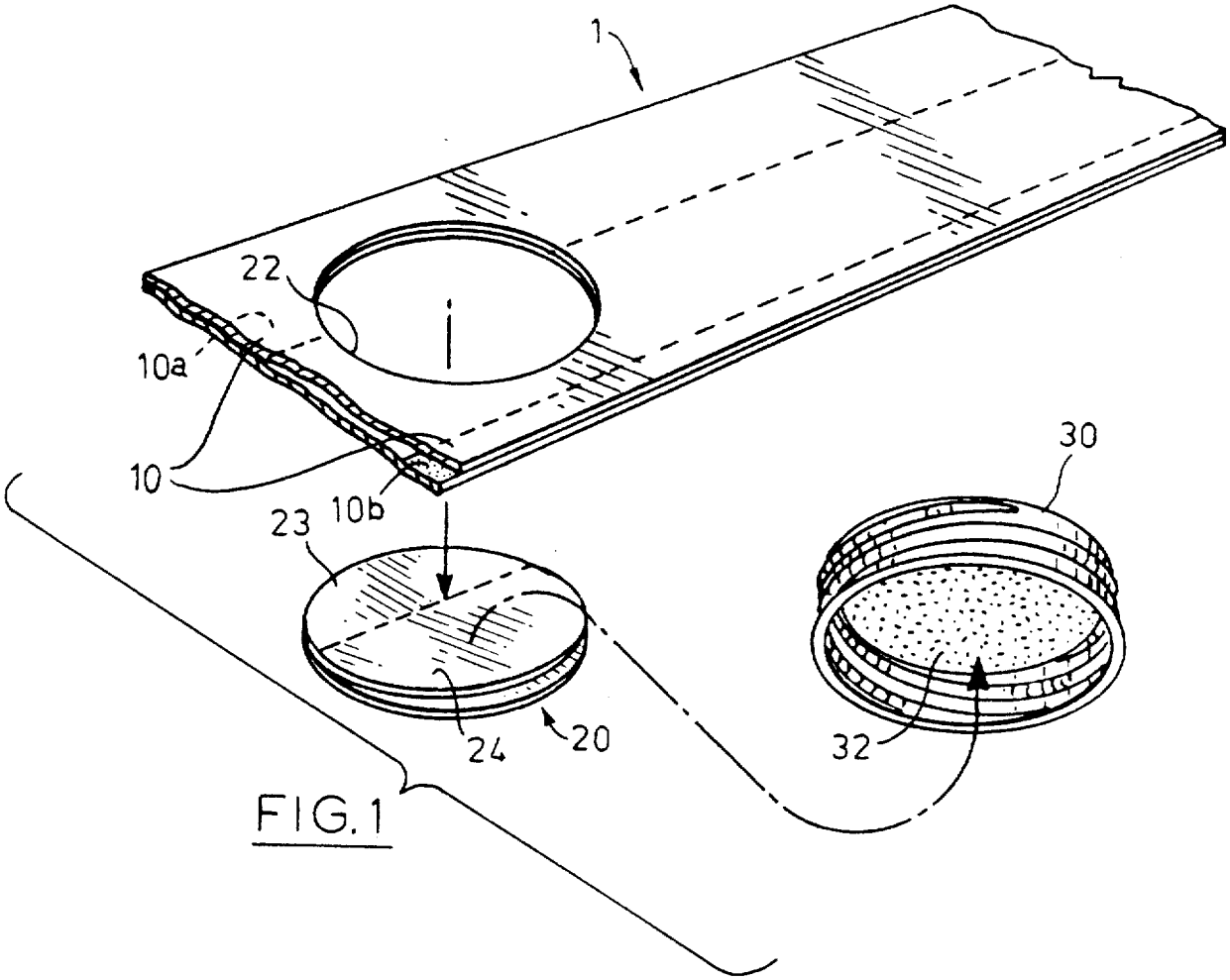
Figure 2:
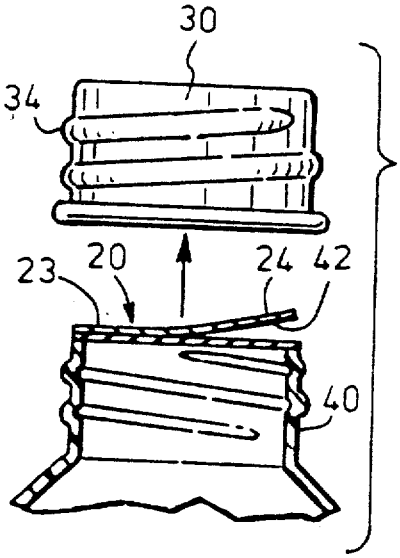
Figure 3:
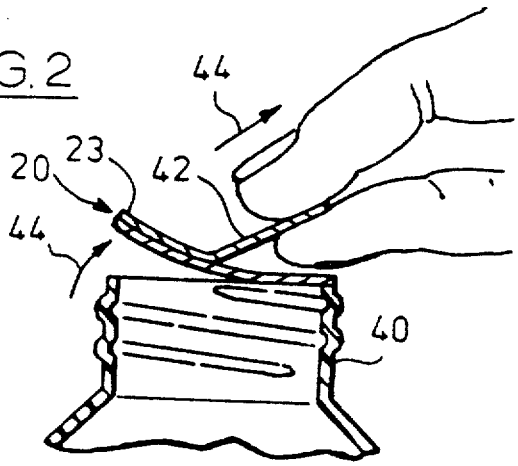

With reference to FIG. 5, a cap for screwing onto a container is shown schematically at 30. The cap 30 is a screw cap, and here is shown as being formed with a uniform wall thickness throughout its planar top wall and cylindrical side wall having a screw thread 34. Within the cap 30, there is a disc 32 of expanded polystyrene or the like, so as to provide a resilient cushioning member. The sealing member 20 is pressed into the cap 30, and is shown in FIG. 5 with the composite and separated portions 23, 24 on the left hand and right hand sides of the figure respectively.

As detailed below, for this usage the membrane 2 is formed from aluminum foil, the first sheet 8 from polyester and the second sheet 14 from paper.

As the sealing member 20 is pressed into the cap 30, the edges of the member 20 will ride over the ridges of the screw thread 34 of the cap 30. The resiliency of the sheet 8 is sufficient to overcome the properties of the membrane 2. The second sheet 14 does not greatly influence the resiliency of the sealing member 20. Consequently, as the edges of the sealing member 20 ride over the ridges 34, the periphery of the first sheet 8 deflects, but tends to spring back to maintain its planar configuration. When the sealing member 20 is fully inserted, as shown in FIG. 5, the composite portion 23 springs back to engage the grooves of the screw thread 34. Similarly, for the separated portion 24, the laminate sheet 6 springs back to engage the grooves of the screw thread. However, the membrane 2, of the separated portion 24 is not bonded to the sheet 8. Consequently, as it rides over the ridges 34 its edge deflects plastically, so as to be permanently deformed. This is indicated at 36. As a consequence, the membrane 2 in the separated portion 24 does not engage the screw threads. However, the engagement by the rest of the sealing member 20 holds the sealing member 20 in position.

Figure 2:
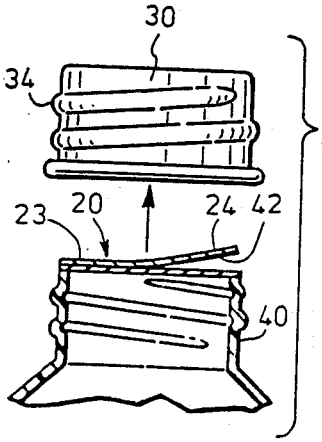
FIG. 2 is a side view showing a section through the neck of a container including a sealing member according to the present invention, and a cap shown removed.

The cap 30 is then screwed on to the neck of a bottle, indicated at 40 in FIG. 2 after filling of the bottle or other container. The cap 30 is screwed on sufficiently, to press the sealing member 20 uniformly against the top of the neck 40. The deformed edge 36 is then pressed against the laminate sheet 6 and conforms to the neck of the container. As there is no tab or other feature providing a varying thickness in the sealing member 20, the disc 32 enables a uniform pressure to be applied over the sealing member 20, so that a uniform pressure should be applied at all points between the sealing member 20 and the lip or neck 40.

In known manner, the bottle neck 40 with the cap 30 is then passed through an induction heating apparatus. This uses high frequency fields to induce currents within the foil of the membrane 2. This heats the foil 2. The heat in turn causes the hot melt bonding material 4 to melt, and upon cooling it bonds the membrane to the top of the bottle neck 40.

The bottle is then ready for distribution, sale, etc.

In use, to open the bottle, the user removes the screw cap 30 in the usual way. This then reveals the sealing member 20 bonded to the bottle 40. On one side, the laminated sheet 6 of the separated portion 24 forms a free tab 42. On the other side, the composite portion 23 is bonded to the bottle neck 40.

Figure 3:
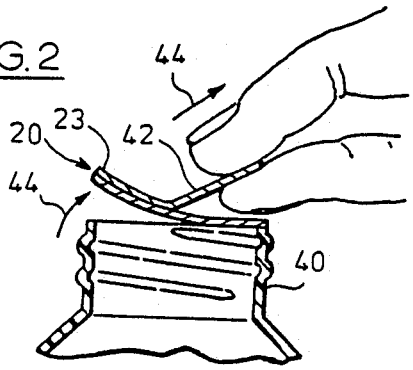
FIG. 3 is a sectional view of the neck of the container of FIG. 2, showing removal of the sealing member.

As shown in FIG. 3, the sealing member 20 can then be removed by grasping the tab 42. The tab 42 is grasped between two fingers and pulled in the direction of the arrows 44, i.e. the tab 42 is generally pulled laterally, rather than upwards. This has the effect of detaching the composite portion 23 from the bottle neck 40, commencing at the portion remote from the separated portion 24. Further pulling on the tab 42 causes complete detachment of the composite portion 23, followed by detachment of the separated portion 24.

The tab 42 is pulled laterally, to make full use of the bond provided by the first layer of adhesive 10. If the tab 42 is pulled upwards, or away from the separated portion 24, there may be a tendency for the first layer of adhesive 10 to separate, depending upon the nature of the various materials used and bond strengths of the adhesive layers 4, 10. Pulling laterally causes the sealing member 20 to separate from the bottle neck 40, as a single unit to leave the neck 40 fully open. With the bottle open, it can be reclosed if desired, with the cap 30 in known manner.

The preferred materials for the sealing member 20 are as follows. For the membrane 2, aluminium foil having a thickness of 0.0015 inches is used. The hot melt bonding material is adhesive no. H0466 supplied by Industrial Adhesives. The first adhesive layer 10 is a composite adhesive, namely Spenbond adhesive 650/651, supplied by NL Chemicals; adhesive 650 is a water dispersed urethane-laminating adhesive, whilst 651 is a water dispersable curing agent for the adhesive. The first sheet 8 is a polyester, supplied by Dupont, having a thickness of 0.001 inches. The further adhesive layer is adhesive no. R0202, again supplied by Industrial Adhesives, this being a water born adhesive. Finally, the second sheet 14 is a bleached kraft paper having a thickness of 0.004 inches and a nominal weight of 52 pounds.

The top of the second sheet 14, which is formed from paper, is visible once the cap 30 has been removed from a bottle. Accordingly, it can be printed with suitable information. Thus, it can be printed with instructions, including arrows etc. indicating the direction in which the tab 42 is to be pulled. It can be printed with any other information desired, for example trade marks, logos, etc. identifying the product.

A preferred manufacturing sequence for producing the strips is as follows. For sealing members having a diameter of approximately $1\frac{3}{8}$ inches, a wide strip is produced having a width of $21\frac{3}{8}$ inches, including ten elongate strips 1. The wide strip is laminated together in the following sequence.

First, the first and second sheets 8, 14 are laminated together. This is achieved by applying adhesive in known manner to one of the sheets and then pressing these two sheets together. This forms the laminated sheet 6. The next step is to dry bond the laminated sheet 6 to the metal foil or membrane 2. This is achieved by applying Spenbond 650/651 adhesive to the laminated sheet 6 (or alternatively to the foil 2), and allowing it to dry until tacky. The membrane or metal foil 2 is then applied. Heat and pressure are then applied to the composite strip, to re-activate the glue and cause the membrane to become bonded to the laminate sheet 6.

Now, it is necessary for the Spenbond adhesive, forming the first adhesive layer 10 to be only applied in strips. This is achieved by using a specially formed roller. The roller essentially comprises raised parts, of constant radius, and slightly recessed parts. Only the recessed parts contact and transfer glue. A doctor blade wipes the adhesive of the raised parts so that they do not transfer any adhesive. Thus, a sheet passed across the roller receives strips of glue. The roller is so dimensioned as to apply the glue in the desired pattern.

The exposed surface of the membrane or foil 2 is then coated with a hot melt bonding material in the known manner.

The composite, wide strip is then formed. It is slit into the elongate strips 1 and printed. In a preferred embodiment, the wide strip having a width of $21\frac{3}{8}$ inches is slit into three intermediate strips each including three elongate strips 1, and a separate single elongate strip 1. These three elongate strips and the single elongate strip 1 are then printed, prior to slitting each of the intermediate strips into three elongate strips 1.

In known manner, the various steps are carried out on continuous lengths of the membrane 2 and first and second sheets 8, 14. In general, after each step, the strip formed was rewound, prior to carrying out the next step. However, with suitable equipment, it may well be possible to carry out the various steps as a continuous operation.

Once the elongate strips 1 have been formed, the sealing members 20 are cut from them by die-cutting so that the various layers have a common periphery. The dies are perfectly shaped, to cleanly cut the sealing members 20. Thus, the die is tapered and is deeper on the side for the separated portion 24.

Whilst the above description has been in relation to a circular sealing member 20, it is to be appreciated that many variations of the invention are possible. Thus, the sealing members need not necessarily be circular, but can be a variety of shapes, e.g. a rounded rectangle, depending upon the nature of the container and the shape of its opening. Additionally, the provision of the second sheet 14 and the corresponding layer of adhesive are not always necessary. For some uses, the single sheet 8 of polyester or the like may be suitable. The width of the composite portion 23 can be varied, depending upon the nature of the materials used, the shape of the opening, etc. In any event, the configuration should preferably be such as to ensure that the membrane 2 is always removed completely, rather than being torn and leaving parts of it in place. It is also possible that other combinations of materials could be used, depending upon the application.

Further, the tab free edge need not correspond exactly to the edge of the membrane. Instead, the tab can be made smaller and have various sizes.

The cap used need not be a screw or even a circular cap. It could have plain side walls and a variety of shapes.

The sealing member can be sealed to a container by a variety of different techniques, e.g. a hot plate rather than induction heating. Further, an adhesive that does not require heating could be used.

We claim:

1. A sealing member adapted for securing to a lip around an opening of a container to close the container, the sealing member comprising: a membrane having a periphery, one side of which is for bonding to the lip of a container; a first sheet; a first layer of adhesive between the membrane and the first sheet bonding facing portions of the membrane and the first sheet together to form a composite portion, whilst leaving at least one portion of the first sheet free in a separated portion of the sealing member, the free portion of the first sheet forming a tab, wherein a part of the periphery of the first sheet forming a tab, wherein a part of the periphery of the membrane bounding that portion of the membrane forming the composite portion is common with a corresponding part of the periphery of the first sheet; and an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container to open the container.

2. A sealing member as claimed in claim 1, wherein all of the membrane and the first sheet have a common periphery.

3. A sealing member as claimed in claim 1, wherein the first layer of adhesive extends between the opposite parts of the periphery of the membrane and up to a line extending across the membrane between ends of said opposite peripheral parts, the line separating said composite portion from said separated portion.

4. A sealing member as claimed in claim 1, which includes a second sheet and a further layer of adhesive bonding the second sheet to the first sheet on a side remote from the membrane, to form a laminated sheet, the second sheet extending into the composite and separated portions.

5. A sealing member as claimed in claim 2, wherein the first layer of adhesive extends between opposite parts of said common periphery and up to a line which extends between ends of said opposite peripheral parts and separates the composite portion from the separated portion.

6. A sealing member as claimed in claim 2, which includes a second sheet and a further layer of adhesive bonding the second sheet to the first sheet on a side remote from the membrane to form a laminated sheet, the second sheet extending into the composite and separated portions.

7. A sealing member as claimed in claim 4 or 5, wherein all of the membrane, the first sheet and the second sheet have a common periphery.

8. A sealing member as claimed in claim 3, which includes a second sheet and a further layer of adhesive bonding the second sheet to the first sheet to form a laminated sheet, the second sheet extending into the composite and separated portions.

9. A sealing member as claimed in claim 3, 5 or 8 wherein said line is straight.

10. A sealing member as claimed in claim 9, wherein said ends of said opposite peripheral parts are generally diametrically opposed to one another.

11. A sealing member as claimed in claim 1, 2, 3, 4, 5, 6, or 8, wherein the additional layer of adhesive comprises a hot melt bonding material.

12. A sealing member as claimed in claim 7, wherein the additional layer of adhesive comprises a hot melt bonding material.

13. A sealing member as claimed in claim 9, wherein the additional layer of adhesive comprises a hot melt bonding material.

14. A sealing member as claimed in claim 10, wherein the additional layer of adhesive comprises a hot melt bonding material.

15. A sealing member as claimed in claim 11, wherein the membrane is formed from a metal foil, which when subject to induction heating is capable of melting the hot melt bonding material.

16. A sealing member as claimed in claim 15, wherein the first sheet is formed from a polyester.

17. A sealing member as claimed in claim 3, 5, or 8, wherein the first layer of adhesive covers all of the membrane on one side of said line between the line and the periphery of the membrane.

18. A sealing member as claimed in claim 17, wherein said line is straight.

19. A sealing member as claimed in claim 18, wherein the membrane is formed from a metal foil and the additional layer of adhesive comprises a hot melt bonding material, whereby the membrane can be heated by induction heating to melt the hot melt bonding material.

20. A sealing member as claimed in claim 19, wherein the line extends diametrically across the sealing member.

21. A sealing member as claimed in 3, 5, or 8, which includes a second line extending across the membrane between other ends of said opposite peripheral parts, so as to separate said composite portion from a second, separated portion in which a second portion of the first sheet is free from the membrane and forms a second tab.

22. A sealing member as claimed in claim 21, wherein each line is straight.

23. A sealing member as claimed in claim 22, wherein the membrane comprises a metal foil and the additional layer of adhesive comprises a hot melt bonding material whereby the membrane can be heated by induction heating to melt the hot melt bonding material.

24. A sealing member adapted for securing to a lip around an opening of a container to close the container, the sealing member comprising: a membrane, one side of which is for bonding to the neck of a container; a first sheet having a periphery that is substantially common with the periphery of the membrane; a first layer of adhesive between the membrane and the first sheet and extending between opposite parts of said common periphery and up to a line which separates a composite portion from a separated portion; a second sheet and a further layer of adhesive bonding the second sheet to the first sheet, with the second sheet having a periphery common to the periphery of the first sheet and the membrane, said composite portion comprising portions of the first and second sheets and the membrane bonded together by the first and second layers of adhesive, and said separated portion comprising portions of the first and second sheets bonded together by the second layer of adhesive which form a free tab and a free portion of the membrane; and an additional layer of adhesive on said one side of the membrane for bonding to the lip of a container, with the first layer of adhesive bonding the first sheet and the membrane together so strongly that, in use, after the additional layer of adhesive has been bonded to the lip of the container, the first sheet and the membrane can be removed as a unit from the lip of the container, to open the container.

25. A sealing member as claimed in claim 25, wherein the additional layer of adhesive comprises a hot melt bonding material.

26. A sealing member as claimed in claim 25, wherein the membrane is formed from a metal foil, which when subject to induction heating is capable of melting the hot melt bonding material, the first sheet is formed from polyester and the second sheet is formed from paper.

27. A sealing member as claimed in claim 26, wherein the first layer of adhesive covers all of the membrane on one side of said line between the line and the periphery of the membrane.

28. A sealing member as claimed in claim 26, wherein the line is straight.

29. A sealing member as claimed in claim 26, which includes a second line separating the composite portion from a second, separated portion, the first sheet being free and forming a second tab in the second portion and the first layer of adhesive covering the membrane between said lines, with each of said lines being straight.

30. A sealing member as claimed in claim 26, 27, 28, or 29, wherein the metal foil comprises aluminum foil having a thickness of approximately 0.0015 inches, the polyester has a thickness of approximately 0.001 inches, and the second sheet is formed from bleached paper having a thickness of approximately 0.004 inches.

31. A sealing member as claimed in claim 1, 3 or 8, in combination with a cap which comprises a cap body having a planar top wall and a side wall, wherein the sealing member is mounted in the cap with a side of the sealing member remote from the membrane facing an inner face of the planar top wall.

32. A sealing member in combination with a cap as claimed in claim 31, wherein the additional layer of adhesive comprises a hot melt bonding material and the membrane comprises a metal foil which is capable of being heated by induction heating, to melt the hot melt bonding material.

33. A sealing member in combination with a cap as claimed in claim 32, in a further combination with a bottle having a neck, wherein the cap is removably engaged with the neck of the bottle and the sealing member is bonded to a free end of the neck by the hot melt bonding material, whereby after removal of the cap, the sealing member can be removed by means of said tab.

34. A sealing member in combination with a cap as claimed in claim 33, wherein the additional layer of adhesive comprises a hot melt bonding material and the membrane comprises a metal foil, which can be heated by induction heating, to melt the additional layer of adhesive.

35. A sealing member as claimed in claim 34, wherein the first layer of adhesive extends between opposite parts of the periphery of the membrane and up to a line extending across the membrane between ends of said opposite peripheral parts, the line being straight and separating said composite portion from said separated portion.

* * * * *

UNITED STATES PATENT AND TRADEMARK OFFICE

CERTIFICATE OF CORRECTION

PATENT NO. : 4,961,986

DATED : Oct. 9, 1990

INVENTOR(S) : Michael P. Galda, et al

It is certified that error appears in the above-identified patent and that said Letters Patent is hereby corrected as shown below:

The title page should be deleted and replaced with the attached sheet.

Sheet 1 should be deleted and replaced with the attached sheet 1.

United States Patent [19]

Galda et al.

[11] Patent Number: 4,961,986

[45] Date of Patent: Oct. 9, 1990

[54] SEALING MEMBER FOR A CONTAINER

[75] Inventors: Michael P. Galda, Acton; Stephen H. Witt, Smithville, both of Canada

[73] Assignee: Stanpac Inc., Smithville, Canada

[21] Appl. No.: 162,787

[22] Filed: Mar. 2, 1988

[30] Foreign Application Priority Data

Sep. 9, 1987 [CA] Canada ..... 546450

[51] Int. Cl.[5] ..... B32B 7/06; B32B 7/10; B32B 7/14

[52] U.S. Cl. ..... 428/201; 428/344; 428/351; 428/354; 428/349; 215/232; 215/250; 215/305; 215/350

[58] Field of Search ..... 428/200, 201, 344, 351, 428/354, 347, 349, 579, 582, 594; 156/291; 215/232, 250, 305, 350; 427/208.2, 208.8, 208.4

[56] References Cited

U.S. PATENT DOCUMENTS

| | | | |
|---|---|---|---|
| 713,824 | 11/1902 | White | 215/298 |
| 745,195 | 11/1903 | Kimsey | 215/298 |
| 756,601 | 4/1904 | Doremus | 215/298 |
| 830,735 | 9/1906 | Olsson | 215/298 |
| 895,719 | 8/1908 | Bradley | 215/298 |
| 902,843 | 11/1908 | Sheppard | 215/298 |
| 1,073,071 | 9/1913 | Hall | 215/298 |
| 2,050,248 | 8/1936 | Eisen | 428/344 |
| 2,937,481 | 5/1960 | Palmer | 215/347 |
| 3,032,225 | 5/1962 | Harding | 215/250 |
| 3,317,068 | 5/1967 | Betner | 215/305 |
| 3,632,004 | 1/1972 | Grimes et al. | 215/40 |
| 3,900,125. | 8/1975 | Wyler et al. | 215/341 |
| 4,044,941 | 8/1977 | Knudsen | 215/232 |
| 4,155,439 | 5/1979 | Fletcher et al. | 271/195 |
| 4,209,126 | 6/1980 | Elias | 229/43 |
| 4,324,601 | 4/1982 | Dembicki et al. | 215/232 |
| 4,423,819 | 1/1984 | Cummings | 215/232 |
| 4,442,129 | 4/1984 | Niwa et al. | 215/232 |
| 4,452,842 | 6/1984 | Borges et al. | 428/95 |
| 4,462,502 | 7/1984 | Luenser et al. | 215/329 |
| 4,469,754 | 9/1984 | Hoh et al. | 428/476.3 |
| 4,501,371 | 2/1985 | Smalley | 215/232 |
| 4,514,248 | 4/1985 | Cummings | 156/268 |
| 4,526,562 | 7/1985 | Knudsen et al. | 493/80 |
| 4,527,703 | 7/1985 | Cummings | 215/232 |
| 4,576,297 | 3/1986 | Larson | 215/250 |
| 4,579,240 | 4/1986 | Ou-Yang | 215/232 |
| 4,588,099 | 5/1986 | Diez | 215/232 |
| 4,588,465 | 5/1986 | Paciorek | 156/220 |
| 4,625,875 | 12/1986 | Carr et al. | 215/232 |
| 4,666,052 | 5/1987 | Ou-Yang | 215/230 |
| 4,722,447 | 2/1988 | Crisci | 215/232 |
| 4,735,335 | 4/1988 | Torterotot | 220/270 |
| 4,754,890 | 7/1988 | Ullman | 215/232 |
| 4,762,246 | 8/1988 | Ashley et al. | 220/270 |
| 4,778,698 | 10/1988 | Ou-Yang | 428/344 |

FOREIGN PATENT DOCUMENTS

| | | |
|---|---|---|
| 040797 | 2/1981 | European Pat. Off. . |
| 128434 | 12/1984 | European Pat. Off. . |
| 135431 | 3/1985 | European Pat. Off. . |
| 2327161 | 5/1977 | France . |
| 209616 | 4/1940 | Switzerland . |
| 659633 | 12/1978 | Switzerland . |
| 283050 | 1/1928 | United Kingdom . |
| 2072131 | 9/1981 | United Kingdom . |

*Primary Examiner*—George F. Lesmes
*Assistant Examiner*—J. Davis
*Attorney, Agent, or Firm*—Rogers, Bereskin & Parr

[57] ABSTRACT

A sealing member for a container has a membrane, e.g. aluminum foil, and a first sheet, e.g. polyester, part of which is bonded to the membrane. The other part of the sheet is free, so as to form a tab, to enable the seal to be detached. The seal can be attached to the neck of a bottle by a hot melt adhesive. The sheet and membrane can be stamped from a compound sheet and be of the same size.

35 Claims, 2 Drawing Sheets

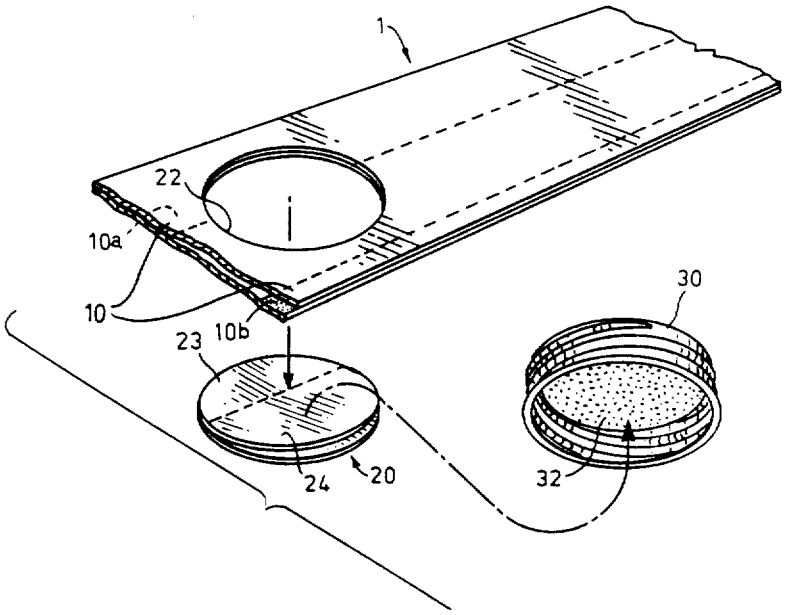

UNITED STATES PATENT AND TRADEMARK OFFICE

CERTIFICATE OF CORRECTION

PATENT NO. : 4,961,986

DATED : Oct. 9, 1990

INVENTOR(S) : Michael P. Galda, Brian M. Klassen, Stephen H. Witt

It is certified that error appears in the above-identified patent and that said Letters Patent is hereby corrected as shown below:

Column 9, lines 8 & 9, delete "wherein a part of the periphery of the first sheet forming a tab,";

Column 9, line 47, replace "or 5" by -- or 6--;

Column 10, line 4, replace "claim 11" by -- claim 14 --;

Column 10, line 40, replace "neck" by -- lip --;

Column 11, line 8, replace "claim 26" by -- claim 27 --;

Signed and Sealed this

Eighth Day of September, 1992

*Attest:*

*Attesting Officer*

DOUGLAS B. COMER

*Acting Commissioner of Patents and Trademarks*

UNITED STATES PATENT AND TRADEMARK OFFICE

CERTIFICATE OF CORRECTION

PATENT NO. : 4,961,986

DATED : October 9, 1990

INVENTOR(S) : Michael P. Galda, Brian M. Klassen, Stephen H. Witt

It is certified that error appears in the above-identified patent and that said Letters Patent is hereby corrected as shown below:

On the title page:

Please add to [75] Inventor(s):

; Brian M. Klassen, Burlington, all of Canada and delete, "both of Canada"

Signed and Sealed this

Twenty-sixth Day of January, 1993

*Attest:*

DOUGLAS B. COMER

*Attesting Officer*

*Acting Commissioner of Patents and Trademarks*

US004961986B1

REEXAMINATION CERTIFICATE (2727th)

United States Patent [19] [11] B1 4,961,986

Galda et al. [45] Certificate Issued Nov. 14, 1995

[54] SEALING MEMBER FOR A CONTAINER

[75] Inventors: Michael P. Galda, Acton; Stephen H. Witt, Smithville; Brian M. Klassen, Burlington, all of Canada

[73] Assignee: Stanpac Inc., Smithville, Canada

Reexamination Request:
No. 90/003,079, Jun. 3, 1993

Reexamination Certificate for:

| | |
|---|---|
| Patent No.: | **4,961,986** |
| Issued: | **Oct. 9, 1990** |
| Appl. No.: | **162,787** |
| Filed: | **Mar. 2, 1988** |

Certificate of Correction issued Sep. 8, 1992.

Certificate of Correction issued Jan. 26, 1993

[30] Foreign Application Priority Data

Sep. 9, 1987 [CA] Canada ..... 546450

[51] Int. Cl.[6] ..... B32B 7/10; B32B 7/14; B65D 41/32; B65D 43/02

[52] U.S. Cl. ..... 428/201; 215/232; 215/250; 215/305; 215/350; 428/344; 428/349; 428/351; 428/354

[58] Field of Search ..... 428/349, 354, 428/200, 201, 344, 347, 579, 582, 594; 156/291; 215/232, 250, 305, 350; 427/208.2, 208.8, 208.4

[56] References Cited

U.S. PATENT DOCUMENTS

| | | |
|---|---|---|
| 713,824 | 11/1902 | White, Jr. . |
| 745,195 | 11/1903 | Kimsey . |
| 756,601 | 4/1904 | Doremus . |
| 830,735 | 9/1906 | Olsson . |
| 895,719 | 8/1908 | Bradley . |
| 902,843 | 11/1908 | Sheppard . |
| 1,073,071 | 9/1913 | Hall . |
| 2,050,248 | 8/1936 | Eisen . |
| 2,077,992 | 4/1937 | Eisen . |
| 2,079,757 | 5/1937 | Berk . |
| 2,131,775 | 10/1938 | Waring . |
| 2,152,012 | 3/1939 | Albion . |
| 2,188,946 | 2/1940 | Gutmann . |
| 2,620,939 | 12/1952 | Weisgerber . |
| 2,646,183 | 7/1953 | Pellett . |
| 2,653,888 | 9/1953 | Hyman, Jr. . |
| 2,937,481 | 5/1960 | Palmer . |
| 3,032,225 | 5/1962 | Harding . |
| 3,202,308 | 8/1965 | Botkin . |
| 3,317,068 | 5/1967 | Betner . |
| 3,330,720 | 7/1967 | Stevens et al. . |
| 3,389,827 | 6/1968 | Abere et al. . |
| 3,391,847 | 7/1968 | Christine et al. . |
| 3,411,419 | 11/1968 | Becker et al. . |
| 3,489,307 | 1/1970 | Wenger . |

(List continued on next page.)

FOREIGN PATENT DOCUMENTS

| | | |
|---|---|---|
| 40797 | 12/1981 | European Pat. Off. . |
| 57436 | 8/1982 | European Pat. Off. . |
| 109592 | 5/1984 | European Pat. Off. . |
| 109593 | 5/1984 | European Pat. Off. . |
| 111900 | 6/1984 | European Pat. Off. . |
| 128434 | 12/1984 | European Pat. Off. . |
| 135431 | 3/1985 | European Pat. Off. . |
| 1343328 | 10/1963 | France . |
| 2327161 | 5/1977 | France . |
| 1916954 | 4/1969 | Germany . |
| 3212990 | 4/1982 | Germany . |
| 209616 | 4/1940 | Switzerland . |
| 565079 | 6/1975 | Switzerland . |
| 659633 | 2/1987 | Switzerland . |
| 283050 | 1/1928 | United Kingdom . |
| 2072131 | 9/1981 | United Kingdom . |
| 2203416 | 10/1988 | United Kingdom . |

*Primary Examiner*—Jenna Davis

[57] ABSTRACT

A sealing member for a container has a membrane, e.g. aluminum foil, and a first sheet, e.g. polyester, part of which is bonded to the membrane. The other part of the sheet is free, so as to form a tab, to enable the seal to be detached. The seal can be attached to the neck of a bottle by a hot melt adhesive. The sheet and membrane can be stamped from a compound sheet and be of the same size.

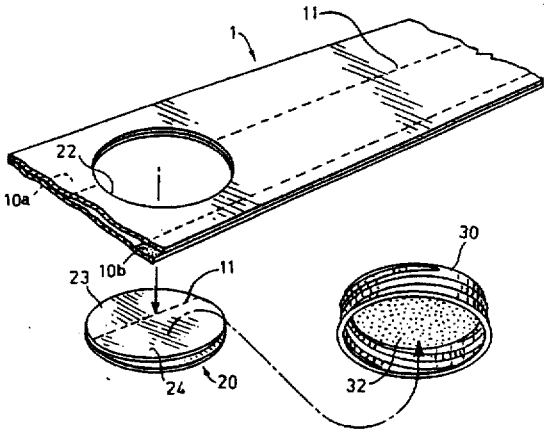

U.S. PATENT DOCUMENTS 3,501,042 3/1970 Risch et al. .
3,549,440 12/1970 Adcock et al. .
3,565,247 2/1971 Brochman .
3,632,004 1/1972 Grimes et al. .
3,637,101 1/1972 Risch .
3,900,125 8/1975 Wyler et al. .
3,923,198 12/1975 Brochman .
3,963,845 6/1976 Dukess .
3,964,415 6/1976 Viker et al. .
3,990,603 11/1976 Brochman .
4,044,941 8/1977 Knudsen .
4,065,908 1/1978 Mueller .
4,108,330 8/1978 Patterson .
4,125,985 11/1978 Laske .
4,135,637 1/1979 Hannula .
4,155,439 5/1979 Fletcher et al. .
4,163,506 8/1979 Patterson .
4,189,060 2/1980 Trotman, III .
4,209,126 6/1980 Elias .
4,215,791 8/1980 Brochman .
4,256,528 3/1981 Patterson .
4,324,601 4/1982 Dembicki et al. .
4,328,905 5/1982 Hardt .
4,372,460 2/1983 Brochman et al. .
4,373,978 2/1983 Patterson .
4,378,074 3/1983 Brochman .
4,390,552 6/1983 Niwa .
4,405,056 9/1983 Patterson .
4,418,834 12/1983 Helms et al. .
4,423,819 1/1984 Cummings .
4,424,911 1/1984 Resnick .
4,436,213 3/1984 Paul, Jr. et al. .
4,442,129 4/1984 Niwa et al. .
4,445,620 5/1984 Brochman et al. .
4,448,326 5/1984 Brochman .
4,452,842 6/1984 Borges et al. .
4,454,956 6/1984 Patterson .
4,462,502 7/1984 Luenser et al. .
4,469,754 9/1984 Hoh et al. .
4,500,011 2/1985 Brochman .
4,501,371 2/1985 Smalley .
4,514,248 4/1985 Cummings .
4,523,689 6/1985 Laub .
4,526,562 7/1985 Knudsen et al. .
4,527,703 7/1985 Cummings .
4,537,327 8/1985 Lu .
4,557,505 12/1985 Schaefer et al. .
4,564,121 1/1986 Brochman .
4,565,738 1/1986 Pardy .
4,576,297 3/1986 Larson .
4,577,777 3/1986 Brochman .
4,579,240 4/1986 Ou-Yang .
4,588,099 5/1986 Diez .
4,588,465 5/1986 Paciorek .
4,595,114 6/1986 Lu .
4,595,434 6/1986 Eckstein et al. .
4,596,338 6/1986 Yousif .
4,602,971 7/1986 Bergeron et al. .
4,625,875 12/1986 Carr et al. .
4,650,082 3/1987 Paciorek .
4,666,052 5/1987 Ou-Yang .
4,673,601 6/1987 Lamping et al. .
4,684,554 8/1987 Ou-Yang .
4,693,390 9/1987 Hekal .
4,697,719 10/1987 Allen .
4,722,447 2/1988 Crisci .
4,733,786 3/1988 Emslander .
4,735,335 4/1988 Torterotot .
4,754,890 7/1988 Ullman et al. .
4,757,914 7/1988 Roth et al. .
4,762,246 8/1988 Ashley et al. .
4,767,016 8/1988 Cook, Jr. et al. .
4,778,069 10/1988 Keller .
4,778,698 10/1988 Ou-Yang .
4,801,041 1/1989 Takata et al. .
4,810,541 3/1989 Newman et al. .
4,872,571 10/1989 Crecelius et al. .
4,961,986 10/1990 Galda et al. .
5,004,111 4/1991 McCarthy .
5,012,946 5/1991 McCarthy .
5,119,964 6/1992 Witt .
5,270,093 12/1993 Galda et al. .

REEXAMINATION CERTIFICATE ISSUED UNDER 35 U.S.C. 307 THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 31 is cancelled.

Claims 1–6, 8, 9, 17, 18, 20–22, 24 and 25 are determined to be patentable as amended.

Claims 7, 10–16, 19, 23, 26–30 and 32–35 dependent on an amended claim, are determined to be patentable.

New claims 36–41 are added and determined to be patentable.

1. A sealing member *in combination with a cap which comprises a cap body having a planar top wall and a side wall, wherein the sealing member is mounted in the cap with a side of the sealing member remote from the membrane facing and abutting an inner face of the planar top wall, the sealing member being* adapted for securing to a lip around an opening of a container to close the container, the sealing member commprising:

(*a*) a membrane having a periphery[, one side of which is for bonding to the lip of a container];

(*b*) a first sheet *having a periphery*;

(*c*) a first layer of adhesive between the membrane and the first sheet bonding facing portions of the membrane and the first sheet together to form (*i*) a *lip* composite portion *adjacent the peripheries of the membrane and the first sheet for extending over portions of the container lip, and*

(*ii*) *a central composite portion for extending over portions of the container opening with the lip composite portion being located between the central composite portion and adjacent peripheries of the membrane and the first sheet and with the central composite portion extending over a substantial part of the sealing member, whilst* *and* leaving at least one portion of the first sheet free [in a separated portion of the sealing member, the free portion of the first sheet forming] *of the membrane to form* a tab, wherein a part of the periphery of [the first sheet forming a tab, wherein a part of the periphery of] the membrane [bounding that portion of the membrane forming] *in* the *lip* composite portion is common with a corresponding part of the periphery of the first sheet, *with the first layer of adhesive bonding the first sheet and the membrane together so strongly that all of the first sheet and all of the membrane can be removed as a unit from the lip of the container to open the container*; and (*d*) an additional layer of adhesive on [said one] *a* side of the membrane [which is adapted] *opposite the first sheet* for bonding *the sealing member directly* to the lip of the container[, with the first layer of adhesive bonding the first sheet and the membrane together so strongly that, in use, the first sheet and the membrane can be removed as a unit from the lip of the container to open the container].

2. A sealing member [as claimed in claim 1,] *adapted for securing to a lip around an opening of a container to close the container, the sealing member comprising:*

(*a*) *a membrane having a periphery;*

(*b*) *a first sheet having a periphery;*

(*c*) *a first layer of adhesive between the membrane and the first sheet bonding facing portions of the membrane and the first sheet together to form*

(*i*) *a lip composite portion adjacent the peripheries of the membrane and the first sheet for extending over portions of the container lip, and*

(*ii*) *a central composite portion for extending over portions of the container opening with the lip composite portion being located between the central composite portion and adjacent peripheries of the membrane and the first sheet and with the central composite portion extending over a substantial part of the sealing member,*

*and leaving at least one portion of the first sheet free of the membrane to form a tab, wherein a part of the periphery of the membrane in the lip composite portion is common with a corresponding part of the periphery of the first sheet, with the first layer of adhesive bonding the first sheet and the membrane together so strongly that all of the first sheet and all of the membrane can be removed as a unit from the lip of the container to open the container; and*

(*d*) *an additional layer of adhesive on a side of the membrane opposite the first sheet for bonding the sealing member directly to the lip of the container and* wherein all of the membrane and the first sheet have a common periphery.

3. A sealing member as claimed in claim 1, *wherein the tab is separated from the lip and central composite portions by a boundary and wherein the membrane and the first sheet have opposite common peripheral parts in the lip composite portion with the boundary extending between ends of the opposite common peripheral parts, and* wherein the first layer of adhesive extends between the opposite *common peripheral* parts [of the periphery of the membrane] and up to [a line extending across the membrane between ends of said opposite peripheral parts, the line separating said composite portion from said separated portion] *the boundary*.

4. A sealing membrane as claimed in claim 1, which includes a second sheet and a further layer of adhesive bonding the second sheet to the first sheet on a side remote from the membrane, to form a laminated sheet, the second sheet extending into the *lip and central* composite [and separated] portions *and into the tab*.

5. A sealing member as claimed in claim 2, *wherein the tab is separated from the lip and central composite portions by a boundary and wherein the membrane and first sheet have opposite common peripheral parts in the lip composite portion with the boundary extending between ends of the opposite common peripheral parts, and* wherein the first layer of adhesive extends between *the* opposite *common peripheral* parts [of said common periphery] and up to [a line which extends between ends of said opposite peripheral parts and separates the composite portion from the separated portion] *the boundary*.

6. A sealing member as claimed in claim 2, which includes a second sheet and a further layer of adhesive bonding the second sheet to the first sheet on a side remote from the membrane to form a laminated sheet, the second sheet extending into the *lip and central* composite [and separated] portions *and into the tab.*

8. A sealing member as claimed in claim 3, which includes a second sheet and a further layer of adhesive bonding the second sheet to the first sheet to form a laminated sheet, the second sheet extending into the *lip and central* composite [and separated] portions *and into the tab.*

9. A sealing member as claimed in claim 3, 5 or 8 wherein said [line] *boundary* is straight.

17. A sealing member as claimed in claim 3, 5, or 8, wherein the first layer of adhesive covers all of the membrane on one side of said [line] *boundary* between the [line] *boundary* and the periphery of the membrane.

18. A sealing member as claimed in claim 17, wherein said [line] *boundary* is straight.

20. A sealing member [as claimed in claim 19,] *adapted for securing to a lip around an opening of a container to close the container, the sealing member comprising:*

*(a) a membrane having a periphery;*

*(b) a first sheet having a periphery;*

*(c) a first layer of adhesive between the membrane and the first sheet bonding facing portions of the membrane and the first sheet together to form*

*(i) a lip composite portion adjacent the peripheries of the membrane and the first sheet for extending over portions of the container lip, and*

*(ii) a central composite portion for extending over portions of the container opening with the lip composite portion being located between the central composite portion and adjacent peripheries of the membrane and the first sheet and with the central composite portion extending over a substantial part of the sealing member,*

*and leaving at least one portion of the first sheet free of the membrane to form a tab, wherein a part of the periphery of the membrane in the lip composite portion is common with a corresponding part of the periphery of the first sheet, with the first layer of adhesive bonding the first sheet and the membrane together so strongly that all of the first sheet and all of the membrane can be removed as a unit from the lip of the container to open the container; and*

*(d) an additional layer of adhesive on a side of the membrane opposite the first sheet for bonding the sealing member directly to the lip of the container;*

*wherein the tab is separated from the lip and central composite portions by a boundary and wherein the membrane and the first sheet have opposite common peripheral parts in the lip composite portion with the boundary extending between ends of the opposite common peripheral parts,*

*wherein the first layer of adhesive extends between the opposite common peripheral parts and up to the boundary,*

*wherein the first layer of adhesive covers all of the membrane on one side of said boundary between the boundary and the periphary of the membrane,*

*wherein the boundary is straight,*

*wherein the membrane is formed from a metal foil and the additional layer of adhesive comprises a hot melt bonding material, whereby the membrane can be heated by induction heating to melt the hot melt bonding material, and* wherein the [line] *boundary* extends diametrically across the sealing member.

21. A sealing member [as claimed in 3, 5, or 8, which] *adapted for securing to a lip around an opening of a container to close the container, the sealing member comprising:*

*(a) a membrane having a periphery;*

*(b) a first sheet having a periphery;*

*(c) a first layer of adhesive between the membrane and the first sheet bonding facing portions of the membrane and the first sheet together to form*

*(i) a lip composite adjacent the peripheries of the membrane and the first sheet for extending over portions of the container lip, and*

*(ii) a central composite portion for extending over portions of the container opening with the lip composite portion being located between the central composite portion and adjacent peripheries of the membrane and the first sheet and with the central composite portion extending over a substantial part of the sealing member,*

*and leaving at least one portion of the first sheet free of the membrane to form a tab, wherein a part of the periphery of the membrane in the lip composite portion is common with a corresponding part of the periphery of the first sheet, with the first layer of adhesive bonding the first sheet and the membrane together so strongly that all of the first sheet and all of the membrane can be removed as a unit from the lip of the container to open the container; and*

*(d) an additional layer of adhesive on a side of the membrane opposite the first sheet for bonding the sealing member directly to the lip of the container;*

*wherein the tab is separated from the lip and central composite portions by a boundary and wherein the membrane and the first sheet have opposite common peripheral parts in the lip composite portion with the boundary extending between ends of the opposite common peripheral parts,*

*wherein the first layer of adhesive extends between the opposite common peripheral parts and up to the boundary, and*

*wherein the sealing member further* includes a second [line] *boundary* extending across the membrane between other ends of said opposite peripheral parts, so as to separate said composite portion from a second, [separated] *free* portion [in which a second portion] of the first sheet [is free from the membrane and forms] *to form* a second tab.

22. A sealing member as claimed in claim 21, wherein each [line] *boundary* is straight.

24. A sealing member adapted for securing to a lip around an opening of a container to close the container, the sealing member comprising: a membrane, one side of which is for bonding to the neck of a container; a first sheet having a periphery that is substantially common with the periphery of the membrane; a first layer of adhesive between the membrane and the first sheet and extending between opposite parts of said common periphery and up to a line which separates a composite portion from a separated portion; a second sheet and a further layer of adhesive bonding the second sheet to the first sheet, with the second sheet having a periphery common to the periphery of the first sheet and the membrane, said composite portion comprising portions of the first and second sheets and the membrane bonded together by the first and second layers of adhesive, and said separated portion comprising portions of the first and second sheets bonded together by the second layer of adhesive which form a free tab and a free portion of the membrane; and an additional layer of adhesive on said one side of the membrane for bonding to the lip of a container, with the first layer of adhesive bonding the first sheet and the membrane together so strongly that, in use, after the additional layer of adhesive has been bonded to the lip of the container, the first [sheet] *and second sheets* and the membrane can be removed as a unit from the lip of the container, to open the container.

25. A sealing member as claimed in claim [25] *24*, wherein the additional layer of adhesive comprises a hot melt bonding material.

*36. A sealing member adapted for securing to a lip around an opening of a container to close the container, the sealing member comprising: a membrane having a membrane peripheral portion for bonding to the lip of a container; a sheet having a periphery; a first layer of adhesive between the membrane and the sheet bonding facing portions of the membrane and the sheet together to form a composite portion, and leaving at least one portion of the sheet free to form a tab, which tab overlaps the membrane peripheral portion, wherein a part of the periphery of the membrane bounding that portion of membrane forming the composite portion is common with a corresponding part of the periphery of the sheet and wherein the sheet and the membrane have a common periphery in the tab; and an additional layer of adhesive on said one side of the membrane which is adapted for bonding the membrane peripheral portion to the lip of the container, with the first layer of adhesive bonding the sheet and the membrane together so strongly that, in use, the sheet and the membrane can be removed as a unit from the lip of the container to open the container.*

*37. A sealing member as claimed in claim 36, wherein the composite portion and tab are separated by a boundary, wherein the membrane and the sheet have opposite, common peripheral parts in the composite portion with the boundary extending between ends of the common peripheral parts, and wherein the first layer of adhesive means extends between the opposite common peripheral parts and up to the boundary.*

*38. A sealing member as claimed in claim 36, in combination with a container including a planar lip, the sealing member being secured to the lip around an opening of a container to close the container, wherein the whole of the sealing member is generally planar.*

*39. A sealing member and a container including a planar lip, the sealing member being secured to the lip around an opening of the container to close the container, the sealing member comprising:*

*(a) a membrane having a periphery;*

*(b) a sheet having a periphery;*

*(c) a first layer of adhesive between the membrane and the sheet bonding facing portions of the membrane and the sheet together to form a composite portion, and leaving at least one portion of the sheet free to form a tab, wherein a part of the periphery of the membrane bounding that portion of the membrane forming the composite portion is common with a corresponding part of the periphery of the sheet, with the first layer of adhesive bonding the first sheet and the membrane together so strongly that, in use, the sheet and the membrane can be removed as a unit from the lip of the container to open the container;*

*(d) an additional layer of adhesive on one side of the membrane remote from the sheet, bonding the membrane to the lip of the container; and*

*(e) wherein the whole of the sealing member is generally planar.*

*40. A combination as claimed in claim 39, wherein the composite and separated portions are separated by a boundary, wherein the membrane and the sheet have opposite common peripheral parts with the boundary extending between ends of the common peripheral parts.*

*41. A sealing member as claimed in claim 39 or 40, wherein the composite portion comprise a lip composite portion extending over the lip of the container and a central composite portion extending over a portion of the container opening.*

* * * * *